US005954442A

United States Patent [19]

Monin-Bareil

[11] Patent Number: 5,954,442

[45] Date of Patent: Sep. 21, 1999

[54] HOLDER FOR LIPSTICK CONTAINER

[75] Inventor: Richard Monin-Bareil, San Cugat del Valles, Spain

[73] Assignee: Techpack Espana S.A., Barcelona, Spain

[21] Appl. No.: 09/059,453

[22] Filed: Apr. 13, 1998

[30] Foreign Application Priority Data

Apr. 15, 1997 [ES] Spain ..... 9700982 U

[51] Int. Cl.[6] ..... A45D 40/12

[52] U.S. Cl. ..... 401/78; 401/87

[58] Field of Search ..... 401/78, 87, 98

[56] References Cited

U.S. PATENT DOCUMENTS

| | | | |
|---|---|---|---|
| 2,332,147 | 10/1943 | Holihan | 401/87 X |
| 2,469,631 | 5/1949 | Broder | 401/78 |
| 2,815,123 | 12/1957 | Safianoff | 401/87 |
| 3,150,770 | 9/1964 | Seaver | 401/87 |
| 5,560,727 | 10/1996 | Vaupel | 401/78 |
| 5,829,900 | 11/1998 | Brown et al. | 401/87 |

FOREIGN PATENT DOCUMENTS

| | | | |
|---|---|---|---|
| 129438 | 10/1946 | Australia | 401/78 |
| 3442094 | 5/1986 | Germany | 401/78 |

*Primary Examiner*—Henry J. Recla
*Assistant Examiner*—Kathleen J. Prunner
*Attorney, Agent, or Firm*—Ostrolenk, Faber, Gerb & Soffen

[57] ABSTRACT

A holder for a lipstick container is designed to improve the degree of attachment of the lipstick bar and to optimize the stability of the lipstick bar inside of the holder. A stop is established in the base of the holder to limit the insertion of the bar. The base is provided with a plurality of harpoons each having an outwardly directed tooth which determines a straight downwardly directed step. Opposite each harpoon is a respective chamfer which provides radial movement of the material of the lipstick bar in order to fill the grooves thus created by the harpoon teeth.

1 Claim, 1 Drawing Sheet

FIG. 1
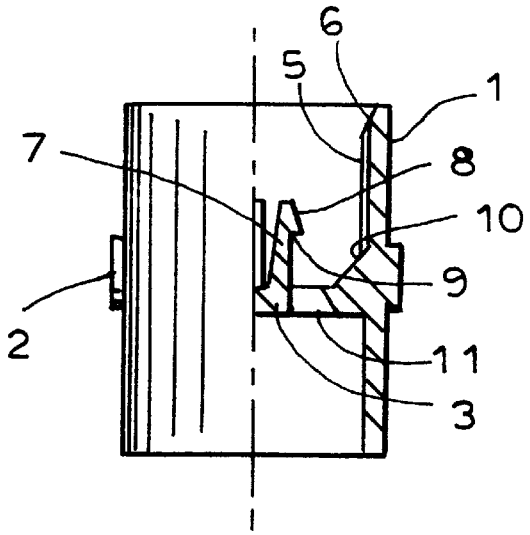
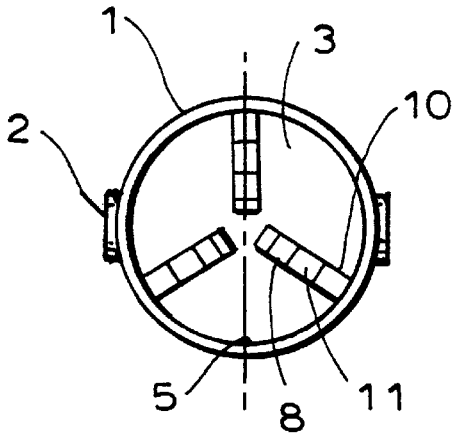
FIG. 2
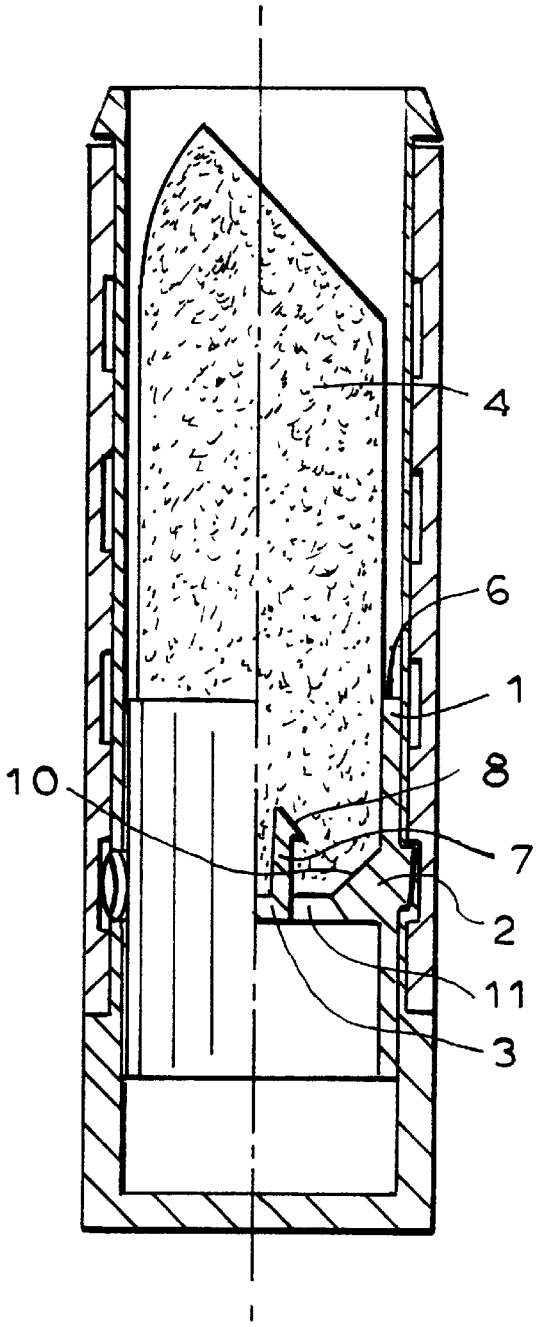
FIG. 3

HOLDER FOR LIPSTICK CONTAINER

OBJECT OF THE INVENTION

The present invention relates to a holder of the type used in lipstick containers for securing the bar or lipstick, which holder has been substantially improved in regard to the degree of attachment provided to the bar or lipstick.

BACKGROUND OF THE INVENTION

Lipstick containers are known to be fitted with an internal holder for carrying the bar or lipstick, said holder moving along a cylindrical guide aided by a spiral element upon rotating the guide, a pair of radial stubs being provided on the holder which penetrate the guide grooves and act on the spiral.

Placement of the bar or lipstick inside the holder is done either through direct molding inside the holder or by previous molding followed by insertion in the holder after the product reaches its solid state.

In this last case, and in order to adequately secure the bar or lipstick in the holder, the holder conventionally incorporates teeth along its lateral surface designed to be driven into the lateral wall of the bar; however, this securing means is generally inadequate, providing a weak attachment of insufficient stability, as previously indicated.

DESCRIPTION OF THE INVENTION

The holder proposed by the invention has been conceived and structured in such a way as to solve this conventional problem, namely the deficient attachment of the lipstick bar, in a fully satisfactory manner.

Toward this end, and more specifically, said holder, based on the structure of a conventional holder, is characteristic in that it employs the classical lateral teeth in addition to internal harpoons which emerge from the bottom of the holder and are substantially separated from the side wall of the holder, preferably uniformly spaced apart along an imaginary circumferential line, in a variable number, preferably three or four, presenting a special feature in that between the side wall and the bottom of the holder, and in correspondence with each of said harpoons, a chamfer is established which reinforces a lateral inner deformation of the lipstick bar after surpassing the respective harpoon, providing movement to the material which fills to a large degree the groove defined by the harpoon, the efficiency of the latter thus being optimized by virtue of the material that exists under the retaining staggered shape defined by the material.

It is thus possible, in the course of the manocuver proper of axially inserting the lipstick bar in the holder, to provide an automatic filling—i.e. without resorting to specific handling—of the grooves defined in the material by the harpoon teeth, thus achieving perfect attachment of the latter to the product and optimum stability of the lipstick bar inside the holder.

DESCRIPTION OF THE DRAWINGS

In order to complement this description and help toward a better understanding of the characteristics of the invention according to a preferred example of a practical embodiment, a set of drawings is attached as an integral part of the description wherein the following is represented in an illustrative and non-limiting character:

FIG. 1 shows a side quarter-section view of a holder for a lipstick container according to the improvements that are the object of the present invention.

FIG. 2 shows a schematic plan view of the same container, according to a variation of the embodiment in which three harpoons are provided.

Finally, FIG. 3 shows a side elevation, in a section similar to that of FIG. 1, following the installation of the lipstick bar in the holder.

PREFERRED EMBODIMENT OF THE INVENTION

In the light of these figures, it is apparent that the holder proposed by the invention, as in the case of a conventional holder, is composed of a cylindrical tubular body (1) fitted with a pair of radial, external, diametrically opposite stubs (2) and carried by the container spiral, said body (1) being defined by a substantially closed base (3) forming a bottom which limits penetration of the bar or lipstick (4) and is fitted with nerves (5) along its inner surface arranged in the direction of their generatrices and designed to be driven into the side surface of the bar (4) in order to adequately immobilize it in an angular direction in respect to the holder (1), said holder being provided with a mouth (6) that is conveniently flared in order to facilitate insertion of the bar or lipstick (4) during assembly.

Thus, based on this basic and conventional structure, the improvements of the invention are centered around the establishment—emerging from the base (3) of the holder of a plurality of harpoons (7), in the amount of three in the example of the practical embodiment shown in the figures, although this number may vary without in the least affecting the essence of the invention, each harpoon (7) tooth (8) being directed outwards and downwards, specifically so in the case of step (9) for retaining the bar (4), while between the holder base (3) and side wall (1) chamfers (10) are defined which numerically and positionally coincide with the harpoons (7), located opposite the harpoon step (9), so that, particularly as shown in FIG. 3, upon installing the bar or lipstick (4), the harpoons (7), on being driven into the bar via the teeth (8), establish channels which open toward the base or lower end of the bar (4) and which are closed immediately thereafter by the movement of the material toward the imaginary axis of the holder by the effect of the chamfers or slanting planes (10), the material thus filling the harpoon steps (9) and optimizing the efficiency thereof.

Finally, it is worthwhile stating that in the base (3) of the holder (1) and in correspondence with the harpoon (7), a hole (11) is defined for the sole purpose of facilitating the demolding of the holder (1) during the holder's injection molding process.

This description need not be more extensive for an expert on the subject to comprehend the scope of the invention and the advantages deriving therefrom.

The materials, shape, size and arrangement of the parts are subject to variation provided the essence of the invention is not altered.

The terms used in wording this specification should be construed at all times in an ample and non-limiting sense.

I claim:

1. Improved holder for lipstick containers, of the type structured by means of a tubular body provided with external stubs for moving along a guide of a lipstick container with the aid of a correspondingly rotating spiral, inside of which tubular body is established a base acting as a stop to limit the insertion of a previously molded bar of lipstick, characteristic in that said base is fitted with a plurality of harpoons, preferably three or four in number, uniformly distributed over an imaginary circumferential line the center of which is positioned in the axis proper of the holder, each said harpoon defining an outwardly directed tooth in turn determining a downwardly directed straight step, namely towards the base of the holder, in a manner that between the side wall and the base of the holder and positioned opposite said harpoons, respective chamfers or slanting planes are established which, in the course of coupling the bar of lipstick and as the harpoons are driven into the bar, produce a radial and inner movement of the material composing the bar designed to fill the grooves defined in said material by said harpoon teeth.

* * * * *